US011697983B2

(12) United States Patent
AlKhateeb et al.

(10) Patent No.: US 11,697,983 B2
(45) Date of Patent: Jul. 11, 2023

(54) PRODUCING HYDROCARBONS WITH CARBON DIOXIDE AND WATER INJECTION THROUGH STACKED LATERAL DUAL INJECTION

(71) Applicant: Saudi Arabian Oil Company, Dhahran (SA)

(72) Inventors: AbdulAziz Salah AlKhateeb, Al Khobar (SA); Amar Jaber M. Alshehri, Dhahran (SA); Surajit Haldar, Udhailiyah (SA); Fahmi Aulia, Udhailiyah (SA)

(73) Assignee: Saudi Arabian Oil Company, Dhahran (SA)

( * ) Notice: Subject to any disclaimer, the term of this patent is extended or adjusted under 35 U.S.C. 154(b) by 104 days.

(21) Appl. No.: 16/989,382

(22) Filed: Aug. 10, 2020

(65) Prior Publication Data

US 2022/0042404 A1 Feb. 10, 2022

(51) Int. Cl.

| | |
|---|---|
| ***E21B 43/16*** | (2006.01) |
| ***E21B 43/20*** | (2006.01) |
| ***E21B 43/30*** | (2006.01) |

(52) U.S. Cl.

CPC ..... *E21B 43/164* (2013.01); *E21B 43/20* (2013.01); *E21B 43/305* (2013.01)

(58) Field of Classification Search

None

See application file for complete search history.

(56) References Cited

U.S. PATENT DOCUMENTS

| | | | | |
|---|---|---|---|---|
| 4,834,179 | A | 5/1989 | Kokolis et al. | |
| 4,850,429 | A * | 7/1989 | Mims | E21B 43/18 166/50 |
| 4,982,786 | A | 1/1991 | Jennings, Jr. | |
| 5,456,315 | A | 10/1995 | Kisman et al. | |

(Continued)

FOREIGN PATENT DOCUMENTS

| | | |
|---|---|---|
| CN | 107740686 | 2/2018 |
| WO | WO 2016139498 | 9/2016 |

OTHER PUBLICATIONS

Meyer, "Summary of Carbon Dioxide Enhanced Oil Recovery (CO2EOR) Injection Well Technology," prepared for the American Petroleum Institute, 2007, 63 pages.

(Continued)

*Primary Examiner* — Anuradha Ahuja

(74) *Attorney, Agent, or Firm* — Fish & Richardson P.C.

(57) ABSTRACT

A first well, configured to act as a production well or an injection well, is formed. The first well includes a first horizontal portion. A second well, configured to act as a production well or an injection well, is formed. The second well includes a second horizontal portion substantially parallel to the first horizontal portion. The first horizontal portion and the second horizontal portion are at different depths. A fluid is injected into a geologic formation through the first well for a first duration of time. Hydrocarbons are produced from the geologic formation through the second well for the first duration of time. A fluid is injected into a geologic formation through the second well for a second duration of time. Hydrocarbons are produced from the geologic formation through the first well for the second duration of time.

11 Claims, 8 Drawing Sheets

(56) References Cited

U.S. PATENT DOCUMENTS

| | | | | |
|---|---|---|---|---|
| 7,506,690 | B2 | 3/2009 | Kelley | |
| 8,215,392 | B2 | 7/2012 | Rao | |
| 9,890,626 | B2 | 2/2018 | Joshari | |
| 10,577,533 | B2 | 3/2020 | Babcock et al. | |
| 2006/0180306 | A1 | 8/2006 | Stone | |
| 2013/0000898 | A1 | 1/2013 | Boone | |
| 2013/0048279 | A1* | 2/2013 | Appel | E21B 43/30 166/275 |
| 2013/0146284 | A1* | 6/2013 | Ayasse | E21B 43/243 166/256 |
| 2017/0044884 | A1* | 2/2017 | Mahmoud | C09K 8/594 |
| 2018/0216449 | A1* | 8/2018 | Benzvi | C09K 8/594 |
| 2018/0340404 | A1* | 11/2018 | Graff | E21B 43/164 |

OTHER PUBLICATIONS

PCT International Search Report and Written Opinion in International Appln No. PCT/2021045193, dated Dec. 3, 2021, 16 pages.

* cited by examiner

PRODUCING HYDROCARBONS WITH CARBON DIOXIDE AND WATER INJECTION THROUGH STACKED LATERAL DUAL INJECTION

TECHNICAL FIELD

This disclosure relates to hydrocarbon production and fluid injection.

BACKGROUND

In hydrocarbon production, a wellbore is formed into a hydrocarbon bearing geologic formation. Once the wellbore is formed and completed, the natural pressures within the hydrocarbon bearing are often used to produce hydrocarbons to a topside facility. In some instances, enhanced recovery options, such gas or water injection, are used to maintain pressure in the reservoir, sweep hydrocarbons towards production wells, or both. Such methods are used to increase the amount of hydrocarbons that can be recovered from a hydrocarbon reservoir.

SUMMARY

This disclosure describes technologies relating to producing hydrocarbons with carbon dioxide and water injection.

An example method of the subject matter described within this disclosure is a method with the following features. A first well, configured to act as a production well or an injection well, is formed. The first well includes a first horizontal portion. A second well, configured to act as a production well or an injection well, is formed. The second well includes a second horizontal portion substantially parallel to the first horizontal portion. The first horizontal portion and the second horizontal portion are at different depths. A fluid is injected into a geologic formation through the first well for a first duration of time. Hydrocarbons are produced from the geologic formation through the second well for the first duration of time. A fluid is injected into a geologic formation through the second well for a second duration of time. Hydrocarbons are produced from the geologic formation through the first well for the second duration of time.

Aspects of the example method, that can be combined with the example method alone or in combination, include the following. The first horizontal portion and the second horizontal portion are within substantially four hundred feet of one another.

Aspects of the example method, that can be combined with the example method alone or in combination, include the following. Injecting fluid includes injecting $CO_2$ for a third duration of time, followed by injecting water for a fourth duration of time. The third and the fourth duration of time total either the first or the second duration of time.

Aspects of the example method, that can be combined with the example method alone or in combination, include the following. The water includes fresh water.

Aspects of the example method, that can be combined with the example method alone or in combination, include the following. The third duration of time for $CO_2$ injection is substantially three months.

Aspects of the example method, that can be combined with the example method alone or in combination, include the following. The fourth duration of time for water injection is substantially three months.

Aspects of the example method, that can be combined with the example method alone or in combination, include the following. Injecting $CO_2$ includes injecting the $CO_2$ at a miscible pressure.

Aspects of the example method, that can be combined with the example method alone or in combination, include the following. Injecting $CO_2$ comprises injecting the $CO_2$ in a supercritical state.

Aspects of the example method, that can be combined with the example method alone or in combination, include the following. Injecting includes injecting carbonated water for the first duration of time.

An example implementation of the subject matter described within this disclosure is a method of producing a hydrocarbon reservoir. The method includes the following features. A fluid is injected into a geologic formation through a first well for a first duration of time. The first well includes a first horizontal portion. Hydrocarbons are produced from the geologic formation through a second well for the first duration of time, the second well comprising a second horizontal portion substantially parallel and substantially vertically aligned with the first horizontal portion. A fluid is injected into the geologic formation through the second well for a second duration of time. Hydrocarbons are produced from the geologic formation through the first well for the second duration of time.

Aspects of the example method, that can be combined with the example method alone or in combination, include the following. Injecting fluid includes injecting $CO_2$ for a third duration of time, followed by injecting water for a fourth duration of time. The third and the fourth duration of time totaling either the first or the second duration of time.

Aspects of the example method, that can be combined with the example method alone or in combination, include the following. The water comprises fresh water.

Aspects of the example method, that can be combined with the example method alone or in combination, include the following. The third duration of time for $CO_2$ injection is substantially three months.

Aspects of the example method, that can be combined with the example method alone or in combination, include the following. The fourth duration of time for water injection is substantially three months.

Aspects of the example method, that can be combined with the example method alone or in combination, include the following. Injecting $CO_2$ includes injecting the $CO_2$ at a miscible pressure.

Aspects of the example method, that can be combined with the example method alone or in combination, include the following. Injecting $CO_2$ includes injecting the $CO_2$ in a supercritical state.

Aspects of the example method, that can be combined with the example method alone or in combination, include the following. Injecting includes injecting carbonated water for the first duration of time.

An example implementation of the subject matter described within this disclosure is a well system with the following features. A first well is within a geologic formation. The first well is configured to act as a production well or an injection well. The first well includes a first horizontal portion. A second well is within a geologic formation. The second well is configured to act as a production well or an injection well. The second well includes a second horizontal portion substantially parallel and substantially vertically aligned with the first horizontal portion. The first horizontal portion and the second horizontal portion are within four hundred feet of one another. A topside facility configured to inject a fluid into the geologic formation through the first well for a first duration of time. The topside facility is configured to produce hydrocarbons from the geologic formation through the second well for the first duration of time. The topside facility is configured to inject a fluid into the geologic formation through the second well for a second duration of time. The topside facility is configured to produce hydrocarbons from the geologic formation through the first well for the second duration of time.

Aspects of the example well system, that can be combined with the example well system alone or in combination, include the following. The injected fluid includes $CO_2$ being injected for a third duration of time, followed by water being injected for a fourth duration of time. The third and the fourth duration of time totaling either the first or the second duration of time.

Aspects of the example well system, that can be combined with the example well system alone or in combination, include the following. The $CO_2$ is collected from a production stream for injection.

Particular implementations of the subject matter described in this disclosure can be implemented so as to realize one or more of the following advantages. A greater recovery factor of hydrocarbons can be realized with the subject matter described herein.

The details of one or more implementations of the subject matter described in this disclosure are set forth in the accompanying drawings and the description. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

When gas is injected into the reservoirs, the gas sometimes flows preferentially on the top of a reservoir due to lower density than hydrocarbons within the reservoir. Such a situation can cause some areas of the reservoir to be un-swept by the injected gas. This disclosure describes a method for enhanced oil recovery that includes sweeping hydrocarbons located between two vertically adjacent, horizontal wellbores. Carbon dioxide is injected into the upper well for a first period of time while the lower well acts as a hydrocarbon producer. Then, the carbon dioxide injection is switched to water injection for a second period while maintaining the lower well as a hydrocarbon producer. Then the upper well is converted to a production well and the lower well acts as an injection well. Carbon dioxide is injected into the lower well for a third period of time while the upper well acts as a hydrocarbon producer. Then, the carbon dioxide injection is switched to water injection for a fourth period of time while maintaining the lower well as an injection well.

Figure 1:
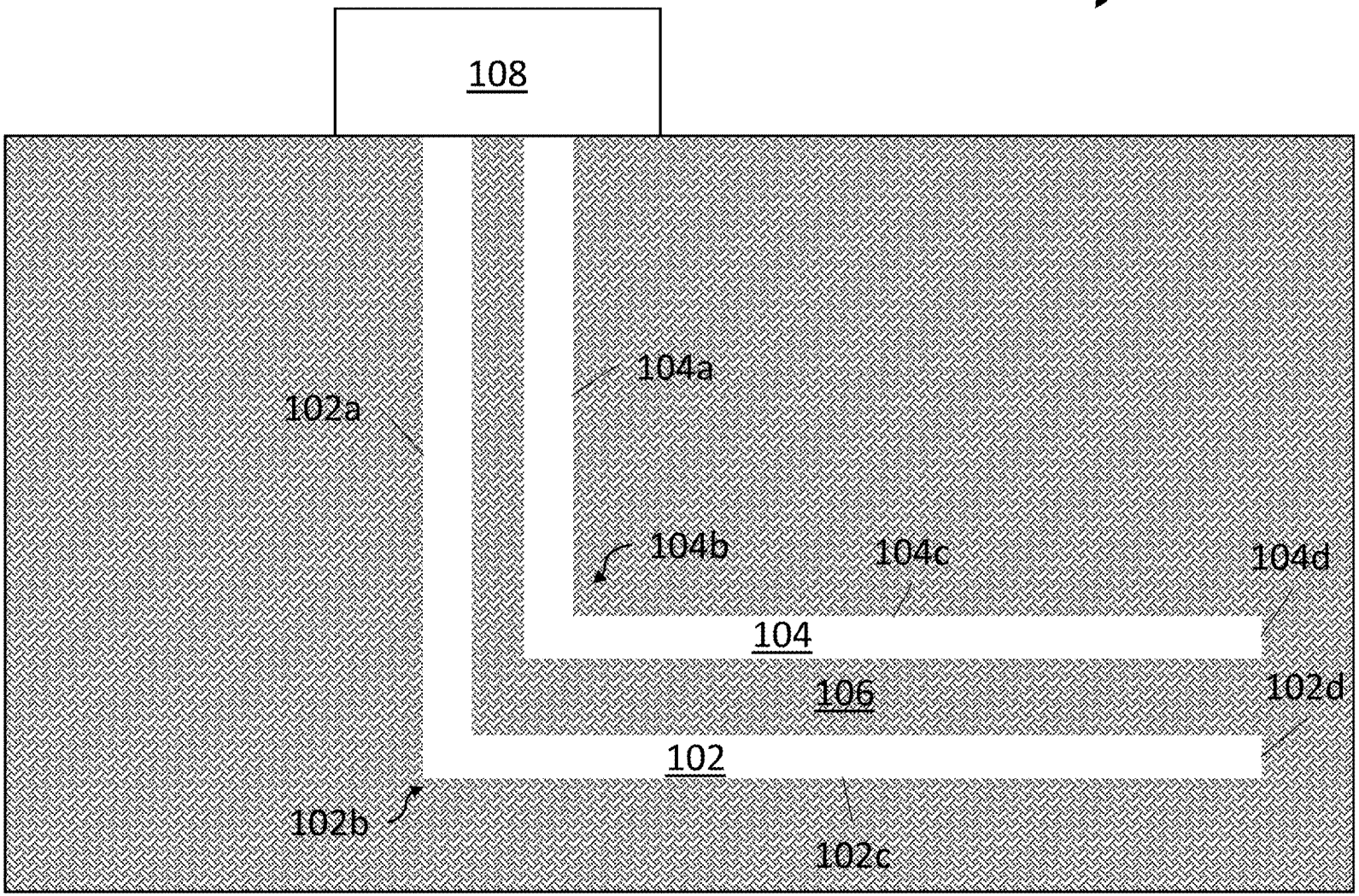
FIG. 1 is a side cross-sectional diagram of an example well system with a first well and a second well.

FIG. 1 is a side cross-sectional diagram of an example well system 100 with a first, lower well 102 and a second, upper well 104. The first, lower well 102 is formed within a geologic formation 106 and is configured to act as a production well or an injection well. The first, lower well 102 includes a vertical portion 102*a*, a heel 102*b*, a first horizontal portion 102*c*, and a toe 102*d*, or downhole end. The second, upper well 104 is also formed within the geologic formation 106. The second, upper well 104 is also configured to act as a production well or an injection well. The second, upper well 104 includes a vertical portion 104*a*, a heel 104*b*, a second horizontal portion 104*c*, and a toe 104*d*, or downhole end. The first horizontal portion 102*c* and the second horizontal portion 104*c* are substantially parallel and substantially vertically aligned with one another (within standard drilling tolerances). In some instances, the first horizontal portion 102*c* and the second horizontal portion 104*c* are vertically within four hundred feet of one another.

A topside facility 108 is located at an uphole end of the first, lower well 102 and the second, upper well 104. The topside facility 108 can include several components common for hydrocarbon production, for example, injection pumps, production pumps, auxiliary pumps, compressors, separators, flare systems, and general utility systems. The topside facility 108 includes facilities and equipment necessary to inject into or produce from either the first, lower well 102, the second, upper well 104, or both, and to change the operating mode of either well. Such an arrangement includes various valving and manifolds that are sufficiently rated for each service. This means that the topside facility 108 is configured to inject a fluid into the geologic formation 106 through the first, lower well 102 for a first duration of time, and produce hydrocarbons from the geologic formation 106 through the second, upper well 104 for the first duration of time. The topside facility 108 is also configured to switch the roles of each wellbore. That is, the first, lower well 102 can be switched from an injection well into a production well, and the second, upper well 104 can be switched from a production well into an injection well. Once the change has occurred, for example, by routing the well tubing of each well into different manifolds, the topside facility 108 then injects a fluid into the geologic formation 106 through the second, upper well 104 and produces hydrocarbons from the geologic formation 106 through the first, lower well 102 for a second duration of time.

Figure 2:
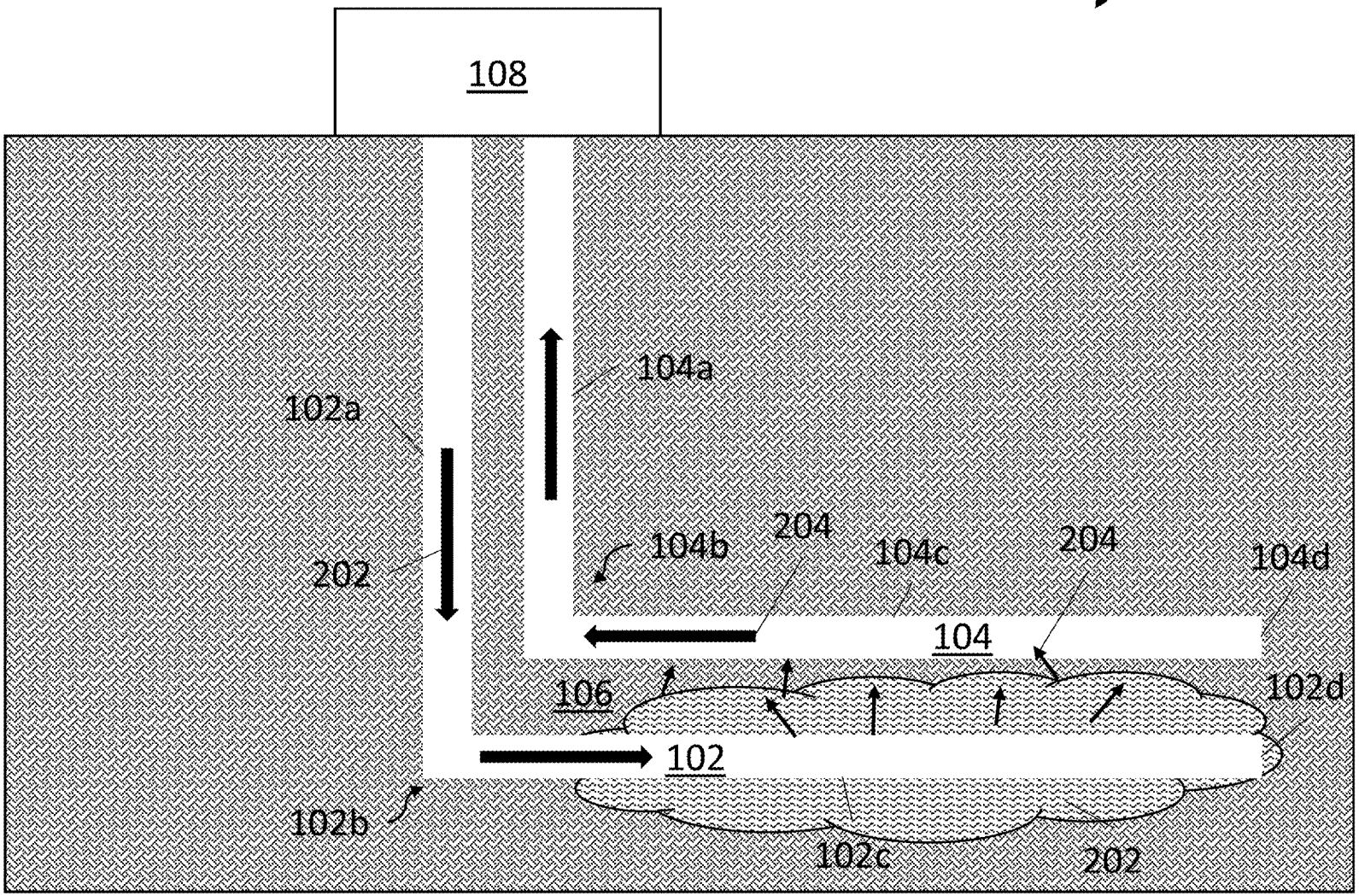
FIG. 2 is a side cross sectional diagram of the example well system with the lower well acting as an injector and the upper well acting as a producer.

FIG. 2 is a side cross sectional diagram of the example well system 100 with the first, lower well 102 acting as an injector and the second, upper well 104 acting as a producer. In operations, a first fluid is injected into the geologic formation 106 through the first, lower well 102 for a first duration of time. In some implementations, the injected fluid includes $CO_2$ 202. In some implementations, $CO_2$ 202 is injected for several months, for example, three months or so. In instances where $CO_2$ 202 is injected, the $CO_2$ 202 is injected at a miscible pressure or in a super critical state.

This allows the $CO_2$ 202 to more easily dissolve into the hydrocarbons 204 within the geologic formation 106. In some implementations, the $CO_2$ 202 is received and processed by the topside facility 108 itself, for example, separated from production fluids taken from the producing well, or taken from exhaust of internal combustion engines at the topside facility 108. In some implementations, the $CO_2$ 202 is provided by a pipeline or is delivered by truck to the topside facility 108.

While $CO_2$ 202 is being injected through the first, lower well 102, hydrocarbons 204 are being swept towards the second, upper well 104. The $CO_2$ 202 dissolves into the hydrocarbons, reducing their density and allowing them to flow more freely than the hydrocarbons would flow without the addition of $CO_2$ 202. Hydrocarbons 204 are produced through the second, upper well 104 for substantially the same duration of time as $CO_2$ 202 is injected into the first, lower well 102.

Figure 3:
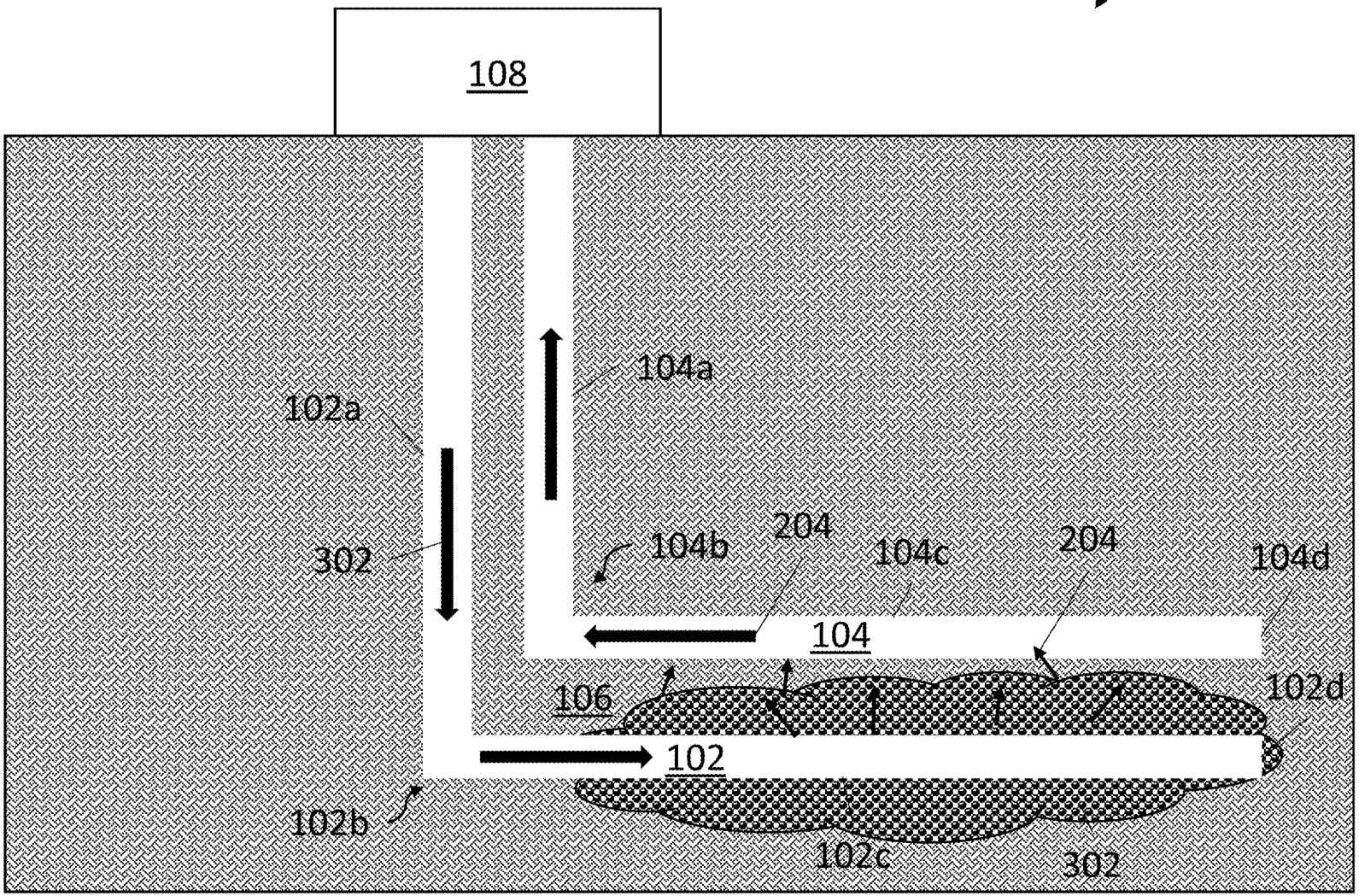
FIG. 3 is a side cross sectional diagram of the example well system with the lower well acting as an injector and the upper well acting as a producer.

FIG. 3 is a side cross sectional diagram of the example well system 100 with the first, lower well 102 acting as an injector and the second, upper well 104 acting as a producer. After $CO_2$ 202 had been injected for a duration of time, water 302 is then injected into the geologic formation 106 through the first, lower well 102. In some implementations, the water 302 is injected for several months, for example, three months or so. The water 302 further sweeps the hydrocarbons 204 towards the producing, second, upper well 104. The injected water 302 can include fresh water, brine, or any other water suitable for downhole injection. Water 302 injection rates can vary based on parameters of the geologic formation 106, for example, the water 302 can be injected at a rate of 5,000 to 10,000 barrels per day at 1,500 to 2,000 pounds per square inch gauge pressure. In some implementations, the water 302 is received and processed by the topside facility 108 itself, for example, the water 302 can be separated from production fluids taken from the producing well. In some implementations, the water 302 is provided by a pipeline, is delivered by truck to the topside facility 108, or is pumped from a local water source, such as a lake or an ocean. The water 302 can be treated with biocide or other additives to reduce the risks of downhole corrosion, microbial growth, or $H_2S$ production from the production wellbore (104 in the present figure).

Figure 4:
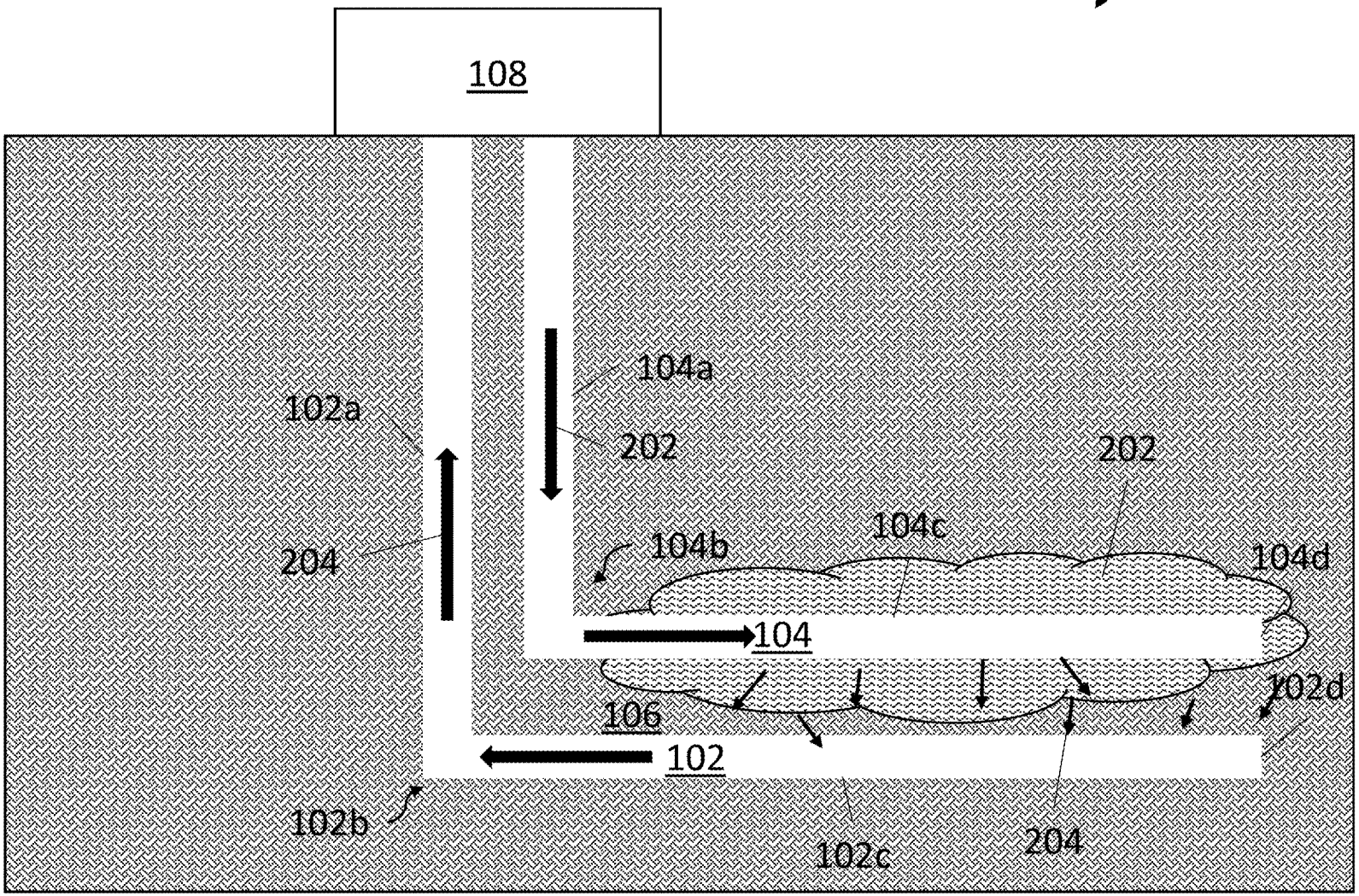
FIG. 4 is a side cross-sectional diagram of the example well system with the upper well acting as an injector and the lower well acting as a producer.

FIG. 4 is a side cross-sectional diagram of the example well system 100 with the second, upper well 104 acting as an injector and the first, lower well 102 acting as a producer. After fluids have been injected into the geologic formation through the first, lower well 102, for example, $CO_2$, 202 followed by water, the first and second well can switch roles. That is, the second, upper well 104 becomes the injection well while the first, lower well 102 becomes a production well. Similar to the previous arrangement, $CO_2$ 202 is first injected at a miscible pressure or in a super critical state to sweep hydrocarbons towards the producing, first, lower well 102. In some implementations, $CO_2$ 202 is injected through the second, upper well 104 for several months, for example, three months or so.

Figure 5:
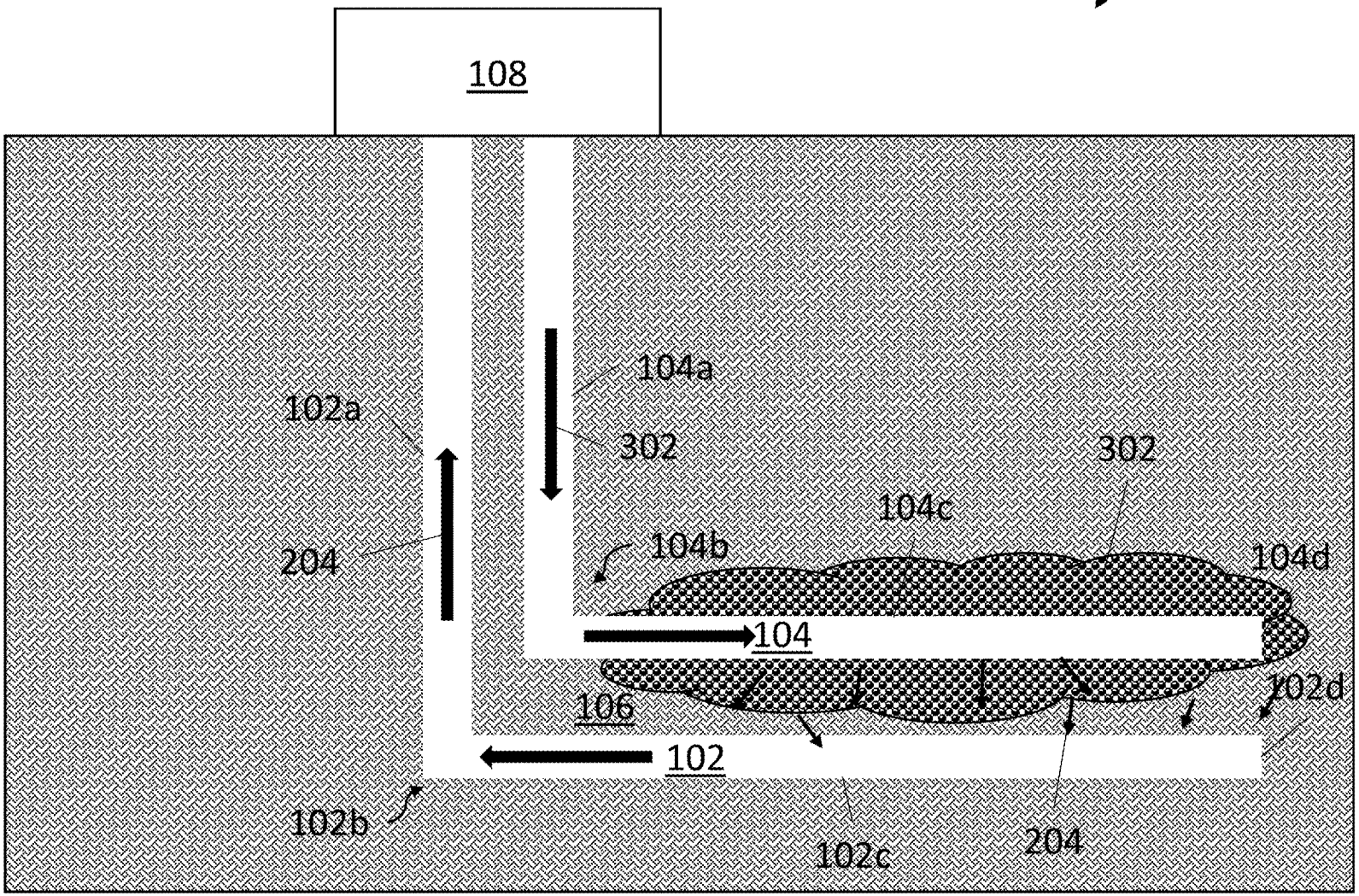
FIG. 5 is a side cross-sectional diagram of the example well system with the upper well acting as an injector and the lower well acting as a producer.

FIG. 5 is a side cross-sectional diagram of the example well system 100 with the second, upper well 104 acting as an injector and the first, lower well 102 acting as a producer. Injecting water 302 through the second, upper well 104 is substantially similar to injecting water 302 through the first, lower well 102, as previously described, with the exception of any differences described herein. After a duration of time injecting $CO_2$ 202, water 302 is then injected through the second, upper well 104 to sweep hydrocarbons towards the producing, first, lower well 102.

Figure 6:
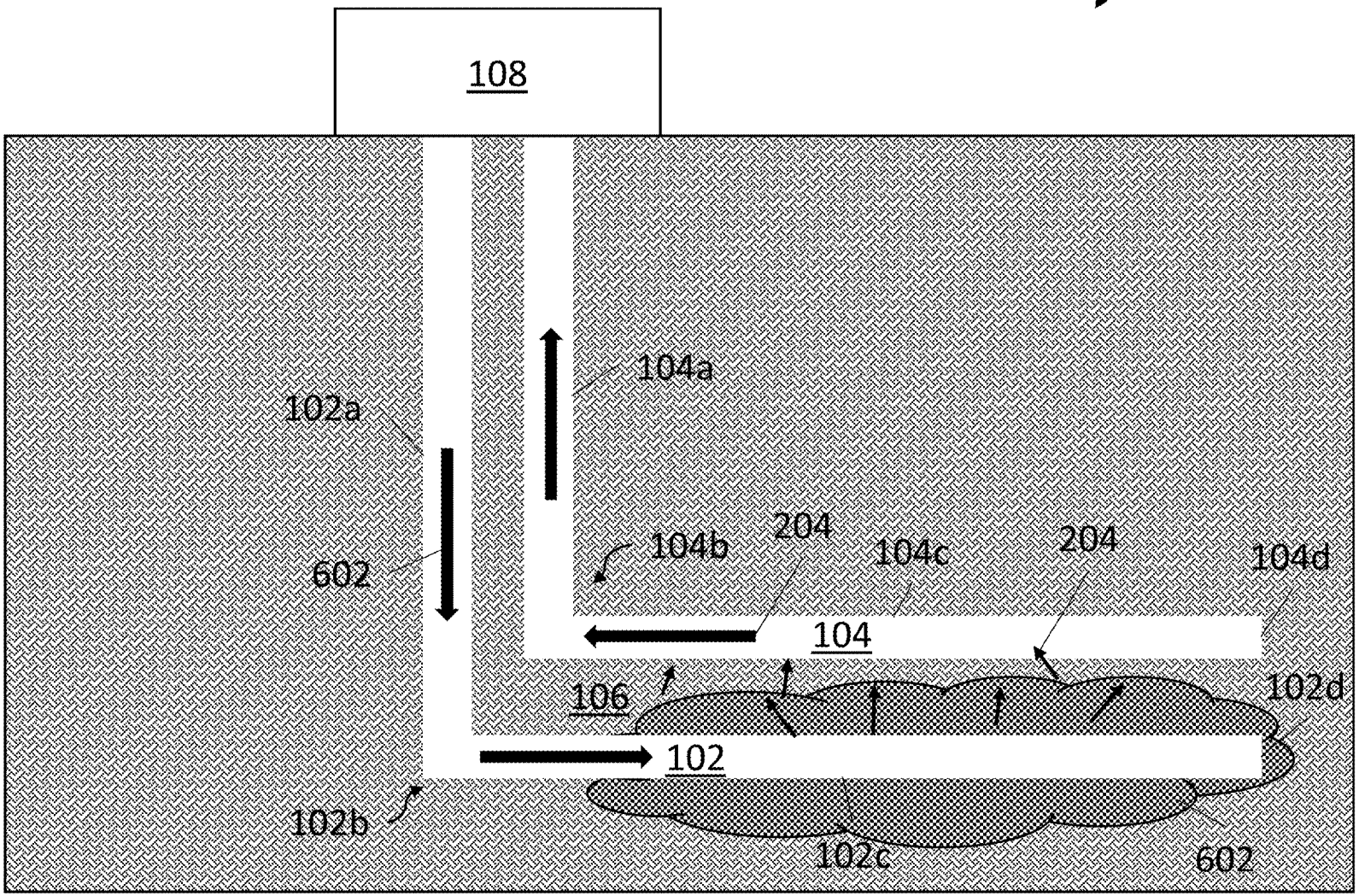
FIG. 6 is a side cross sectional diagram of the example well system with the lower well acting as an injector and the upper well acting as a producer.

FIG. 6 is a side cross sectional diagram of the example well system 100 with the first, lower well 102 acting as an injector and the second, upper well 104 acting as a producer. In some implementations, the $CO_2$ and water can be combined and carbonated water 602 can be injected through the first, lower well 102 into the geologic formation 106. In some implementations, carbonated water 602 is injected for several months, for example, three to six months or so. The carbonated water 602 can include freshwater or brine. The carbonated water 602 can be treated with biocide or other additives to reduce the risks of downhole corrosion, microbial growth, or $H_2S$ production from the production wellbore (104 in the present figure). Similar to the previously described operations, the carbonated water 602 both reduces the density of the hydrocarbons and sweeps the hydrocarbons towards the producing, second, upper well 104.

Figure 7:
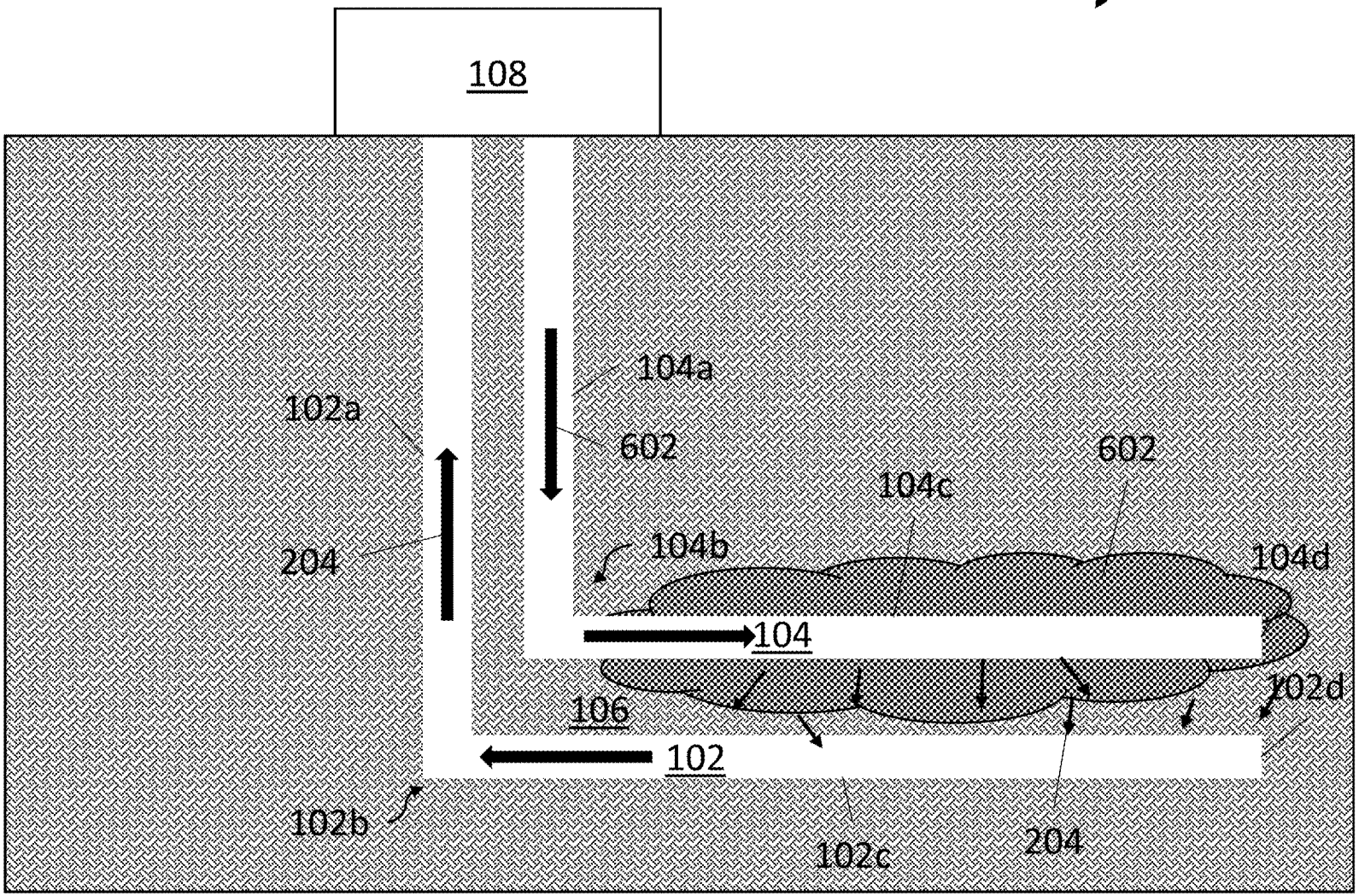
FIG. 7 is a side cross-sectional diagram of the example well system with the upper well acting as an injector and the lower well acting as a producer.

FIG. 7 is a side cross-sectional diagram of the example well system 100 with the second, upper well 104 acting as an injector and the first, lower well 102 acting as a producer. After the carbonated water 602 has been injected into the geologic formation 106 through the first, lower well 102, the first, lower well 102 and second, upper well 104 can switch roles. That is, the second, upper well 104 becomes the injection well while the first, lower well 102 becomes a production well. Similar to the previous arrangement, carbonated water 602 is injected for several months, for example, three to six months or so. As previously stated, the carbonated water 602 both reduces the density of the hydrocarbons and sweeps the hydrocarbons towards the producing, first, lower well 102.

While a single injection-production cycle is described throughout this disclosure, it is understood that such cycles can be repeated. That is, the lower well 102 can act as an injector, then a producer, and then an injector again. Similarly, the upper well 104 can act as a producer, an injector, then a producer again. While primarily described within this disclosure as first injecting through the lower well 102 and producing through the upper well 104, other arrangements can be used without departing from this disclosure.

Figure 8:
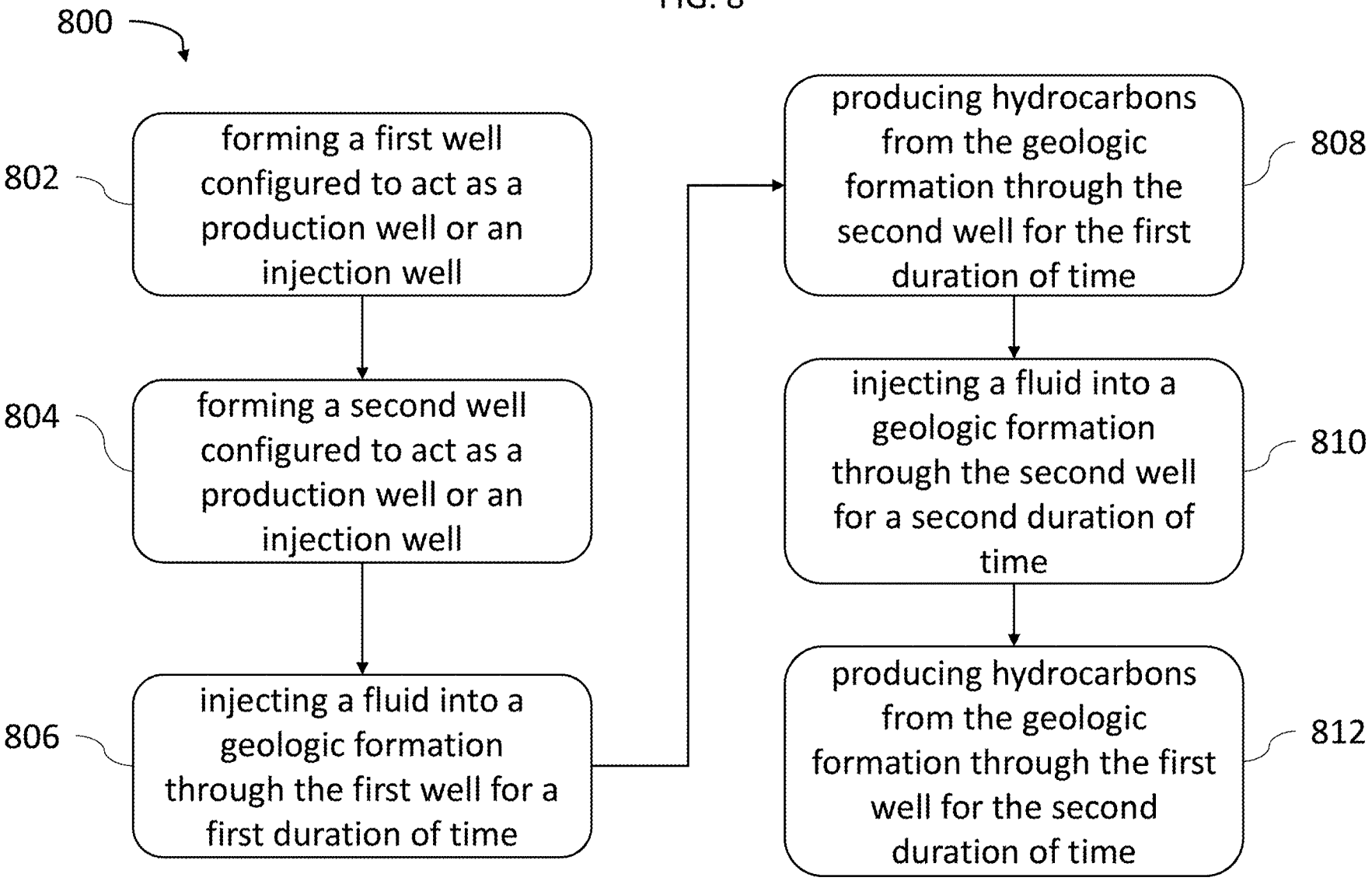
FIG. 8 is a flowchart of an example method that can be used with aspects of this disclosure.

FIG. 8 is a flowchart of an example method 800 that can be used with aspects of this disclosure. At 802, a first well configured to act as a production well or an injection well is formed. The first well includes a first horizontal portion. At 804, a second well configured to act as a production well or an injection well is formed. The second well includes a second horizontal portion substantially parallel to the first horizontal portion. The first horizontal portion and the second horizontal portion are at different depths, and the first horizontal portion or the second horizontal portion is above the other. In some implementations, the first horizontal portion and the second horizontal portion are within substantially four hundred feet of one another (within standard drilling tolerances).

At 806, a fluid is injected into a geologic formation through the first well for a first duration of time. In some implementations, injecting fluid includes injecting $CO_2$ for a third duration of time, followed by injecting water for a fourth duration of time, the third and the fourth duration of time totaling either the first or the second duration of time. In some implementations, carbonated water is injected for the first duration of time. The duration of time for injection can be on the order of several months.

At 808, hydrocarbons are produced from the geologic formation through the second well for the first duration of time. At 810, a fluid is injected into a geologic formation through the second well for a second duration of time. At 812, hydrocarbons are produced from the geologic formation through the first well for the second duration of time.

While this disclosure contains many specific implementation details, these should not be construed as limitations on the scope of any inventions or of what may be claimed, but rather as descriptions of features specific to particular implementations of particular inventions. Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the implementations described above should not be understood as requiring such separation in all implementations, and it should be understood that the described program components and systems can generally be integrated together in a single product or packaged into multiple products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. A method comprising:

forming a first well at a first depth within a geologic formation, wherein the first well comprises a first horizontal portion, and wherein the first well is configured to act as a production well or as an injection well;

forming a second well at a second depth within the geologic formation, wherein the second depth is four hundred feet above the first depth, wherein the second well comprises a second horizontal portion that is parallel to the first horizontal portion, and wherein the second well is configured to act as a production well or as an injection well;

during a first three-month period of time:

injecting first $CO_2$ into the geologic formation through the first well to sweep first hydrocarbons within the geologic formation upward towards the second well, producing first production fluids from the geologic formation through the second well, the first production fluids comprising the first hydrocarbons, and separating second CO2 from the first production fluids;

during a second three-month period of time occurring after the first three-month period of time:

injecting water into the geologic formation through the first well to sweep second hydrocarbons within the geologic formation upward towards the second well, and producing the second hydrocarbons from the geologic formation through the second well;

during a third three-month period of time occurring after the second three-month period of time:

injecting the second $CO_2$ into the geologic formation through the second well to sweep third hydrocarbons within the geologic formation downward towards the first well, producing second production fluids from the geologic formation through the first well, the second production fluids comprising the third hydrocarbons, and separating third $CO_2$ from the second production fluids; and during a fourth three-month period of time occurring after the third three-month period of time, injecting the third $CO_2$ into the geologic formation through the first well to sweep fourth hydrocarbons within the geologic formation upward towards the second well.

2. The method of claim 1, wherein the second horizontal portion is vertically aligned with the first horizontal portion.

3. The method of claim 1, wherein the water comprises fresh water.

4. The method of claim 1, wherein the first $CO_2$ is injected in a supercritical state.

5. The method of claim 1, wherein the first $CO_2$ is in the form of carbonated water.

6. A method of producing hydrocarbons from a geologic formation, the method comprising: during a first three-month period of time:

injecting first $CO_2$ into the geologic formation through a first well to sweep first hydrocarbons within the geologic formation upward, the first well comprising a first horizontal portion located at a first depth within the geologic formation, producing first production fluids from the geologic formation through a second well, wherein the second well comprises a second horizontal portion that is located at a second depth within the geologic formation, wherein the second depth is four hundred feet above the first depth, wherein the second horizontal portion is parallel and vertically aligned with the first horizontal portion, and wherein the first production fluids comprise the first hydrocarbons, and separating second $CO_2$ from the first production fluids;

during a second three-month period of time occurring after the first three-month period of time:

injecting water into the geologic formation through the first well to sweep second hydrocarbons within the geologic formation upward towards the second well, and producing the second hydrocarbons from the geologic formation through the second well;

during a third three-month period of time occurring after the second three-month period of time:

injecting the second $CO_2$ into the geologic formation through the second well to sweep third hydrocarbons within the geologic formation downward towards the first well, producing second production fluids from the geologic formation through the first well, the second production fluids comprising the third hydrocarbons, and separating third $CO_2$ from the second production fluids; and during a fourth three-month period of time occurring after the third three-month period of time, injecting the third CO2 into the geologic formation through the first well to sweep fourth hydrocarbons within the geologic formation upward towards the second well.

7. The method of claim 6, wherein the water comprises fresh water.

8. The method of claim 6, wherein the first $CO_2$ is injected in a supercritical state.

9. The method of claim 6, wherein the first $CO_2$ is in the form of carbonated water.

10. A well system comprising:

a first well at a first depth within a geologic formation, wherein the first well is configured to act as a production well or an injection well, and wherein the first well comprises a first horizontal portion;

a second well at a second depth within the geologic formation, wherein the second depth is four hundred feet above the first depth, wherein the second well is configured to act as a production well or an injection well, wherein the second well comprises a second horizontal portion that is parallel and vertically aligned with the first horizontal portion; and a topside facility configured to:

during a first three-month period of time:

inject first $CO_2$ into the geologic formation through the first well to sweep first hydrocarbons within the geologic formation upward towards the second well, produce first production fluids from the geologic formation through the second well, the first production fluids comprising the first hydrocarbons, and separate second $CO_2$ from the first production fluids;

during a second three-month period of time occurring after the first three-month period of time:

inject water into the geologic formation through the first well to sweep second hydrocarbons within the geologic formation upward towards the second well, and produce the second hydrocarbons from the geologic formation through the second well;

during a third three-month period of time occurring after the second three-month period of time:

inject the second $CO_2$ into the geologic formation through the second well to sweep third hydrocarbons within the geologic formation downward towards the first well, produce second production fluids from the geologic formation through the first well, the second production fluids comprising the third hydrocarbons, and separate third $CO_2$ from the second production fluids; and during a fourth three-month period of time occurring after the third three-month period of time, inject the third $CO_2$ into the geologic formation through the first well to sweep fourth hydrocarbons within the geologic formation upward towards the second well.

11. The well system of claim 10, wherein the first $CO_2$ is collected from a production stream for injection.

* * * * *